United States Patent [19]

Saito et al.

[11] Patent Number: 4,821,075

[45] Date of Patent: Apr. 11, 1989

[54] DEVELOPING DEVICE AND DEVELOPER SUPPLY DEVICE FOR THE SAME

[75] Inventors: Takeshi Saito, Tokyo; Hiromitsu Takagaki, Yokohama, both of Japan

[73] Assignee: Ricoh Company, Ltd., Tokyo, Japan

[21] Appl. No.: 97,168

[22] Filed: Sep. 16, 1987

[30] Foreign Application Priority Data

Sep. 20, 1986 [JP] Japan ..... 61-223216
Sep. 20, 1986 [JP] Japan ..... 61-223220
Sep. 20, 1986 [JP] Japan ..... 61-223221

[51] Int. Cl.[4] ..... G03G 15/00; G03G 9/14
[52] U.S. Cl. ..... 355/3 DD; 118/657
[58] Field of Search ..... 355/10, 3 DD, 14 D, 355/14 C, 14 R; 364/900; 271/4, 287; 430/122; 222/DIG. 1; 118/657, 658

[56] References Cited

U.S. PATENT DOCUMENTS 3,892,672 7/1975 Gawron ..... 355/3 DD X
4,133,477 1/1979 Marino et al. ..... 355/14 C X
4,545,326 10/1985 Carl ..... 355/10 X
4,546,060 10/1985 Miskinis et al. ..... 118/657 X
4,583,843 4/1986 Ohata et al. ..... 355/3 DD
4,615,606 10/1986 Nishikawa ..... 355/3 DD
4,734,737 3/1988 Koichi ..... 355/3 DD X

*Primary Examiner*—Donald A. Griffin

*Attorney, Agent, or Firm*—Oblon, Fisher, Spivak, McClelland & Maier

[57] ABSTRACT

A developing device and a toner supply device for a color copier and others. A toner supply conduit adapted to transport fresh toner from the toner supply device is disposed in a developer chamber of the developing device. The wall of the toner supply conduit is perforated to form inlet openings and outlet openings for a developer which is stored in the developer chamber and contains toner and carrier. The inlet openings of the conduit are located in the vicinity of a predetermined position where the developer is to be separated from a developer conveying member. Provided in the toner supply conduit is a transport member for mixing and transporting the fresh toner and the developer which is introduced through the inlet openings. At least a part of the transport member is made of a magnetic material, and at least a part of the magnetic part is situated within the reach of a magnetic force of a magnet which forms a part of the developer conveying member. The toner supply device comrises a toner tank, and a feed member for feeding the fresh toner out of the toner tank. The frequency of operation of at least one of the toner feed member and other operable members which are associated with the toner feed member is counted. The end of toner is displayed when the frequency counted reaches a predetermined one representative of a decrease of toner in the toner tank to zero or to below a predetermined amount.

10 Claims, 9 Drawing Sheets

DEVELOPING DEVICE AND DEVELOPER SUPPLY DEVICE FOR THE SAME

BACKGROUND OF THE INVENTION

The present invention relates to a developing device and, more particularly, to a rotary multi-color developing device applicable to, for example, a color electrophotographic copier having a plurality of developing units which are movable in a rotational motion to a predetermined developing station. The present invention also relates to a developer supply device for feeding toner, or developer, from a toner tank by a toner feed member which is operated within the tank, thereby supplying the toner to a developer chamber of the developing device.

A rotary multi-color developing device is disclosed in, for example, U.S. patent application Ser. No. 039,741 filed Apr. 20, 1987 and assigned to Ricoh Company Ltd., and such a type of developing device has been applied to a color electrophotographic copier and other image-forming apparatuses. In this type of developing device which uses a two-component developer, i.e., a mixture of toner and carrier, toner is transferred to a photoconductive element, or image carrier, to be sequentially consumed as the developing operation is repeated. Hence, additional toner has to be replenished to a developer chamber of the device as occasion arises. This is implemented with a toner supply conduit which extends from a toner supply device which is provided with a toner tank. In this instance, because toner is poorer in fluidity than carrier, should toner be fed alone through the toner supply conduit, its transport might be impaired. In the light of this, it has been customary to form some openings through the toner supply conduit in order to introduce into the conduit a developer which includes carrier and is stored in the developer chamber, the carrier being mixed with toner which is fed from the tank. This allows the toner to be transported with enhanced fluidity and discharged together with the carrier from an outlet of the conduit. Such a toner supply conduit is disclosed in, for example, Japanese Laid-Open Utility Model Publication (Kokai) No. 56-74457/1981. However, simply providing openings in the toner supply conduit as mentioned above fails to allow the toner to flow into the conduit with efficiency. Specifically, because a sufficient amount of developer cannot be introduced into the conduit, it is difficult for the developer inside the conduit to attain a desired degree of fluidity.

Meanwhile, the toner supply device is constructed such that toner stored in the toner tank is fed out by a toner feed member which is disposed in the tank, the toner being transported through the toner supply conduit to the developer chamber. The toner tank, too, has to be replaced with a new one when it is exhausted or substantially exhausted due to repeated developing operations. A problem heretofore pointed out with this kind of toner supply device is that a toner end sensing and displaying means which urges an operator to replace the toner tank is considerably complicated in construction and, therefore, expensive.

SUMMARY OF THE INVENTION

It is, therefore, an object of the present invention to provide a developing apparatus which allows a substantial amount of developer to be introduced from a developer chamber into a toner supply conduit which is adapted to transport toner fed from a toner supply device, thereby providing the toner inside the conduit with a sufficient degree of fluidity.

It is another object of the present invention to provide a toner supply device having a toner end sensing and displaying capability which informs an operator of the timing for replacing a toner tank.

In accordance with the present invention, there is provided a developing device for developing an electrostatic latent image provided on an image carrier of an image-forming apparatus by using a two-component developer which contains toner and carrier, comprising a developer chamber for accommodating the developer, a developer conveying member located to face the image carrier for conveying the developer in the developer chamber to a predetermined developing station, a developer separating member for once separating the developer moved past the developing station from the developer conveying member at a predetermined separating position, and a toner supplying means located in the vicinity of the separating position for introducing fresh toner from outside into the developer chamber, then mixing the fresh toner with the developer in the developer chamber, which contains the carrier therein, and then supplying a mixture of the fresh toner and the developer to the developer chamber.

In accordance with the present invention, there is also provided a toner supply device for supplying fresh toner to a developer chamber of a developing device which is mounted in an image-forming apparatus, comprising a toner tank for accommodating the fresh toner, a toner feed member operable for feeding the fresh toner in the toner tank to the developing chamber, and a toner end sensing means for counting a frequency of operation of at least one of the toner feed member and other operable members which are interlocked with the toner feed member, and sensing an end of toner when reached a predetermined count.

The above and other objects, features and advantages of the present invention will become more apparent from the following detailed description taken with the accompanying drawings.

DESCRIPTION OF THE PREFERRED EMBODIMENTS

To better understand the present invention, a reference will be made to a rotary multi-color developing device to which the present invention is applied, shown in FIG. 1.

Figure 1:
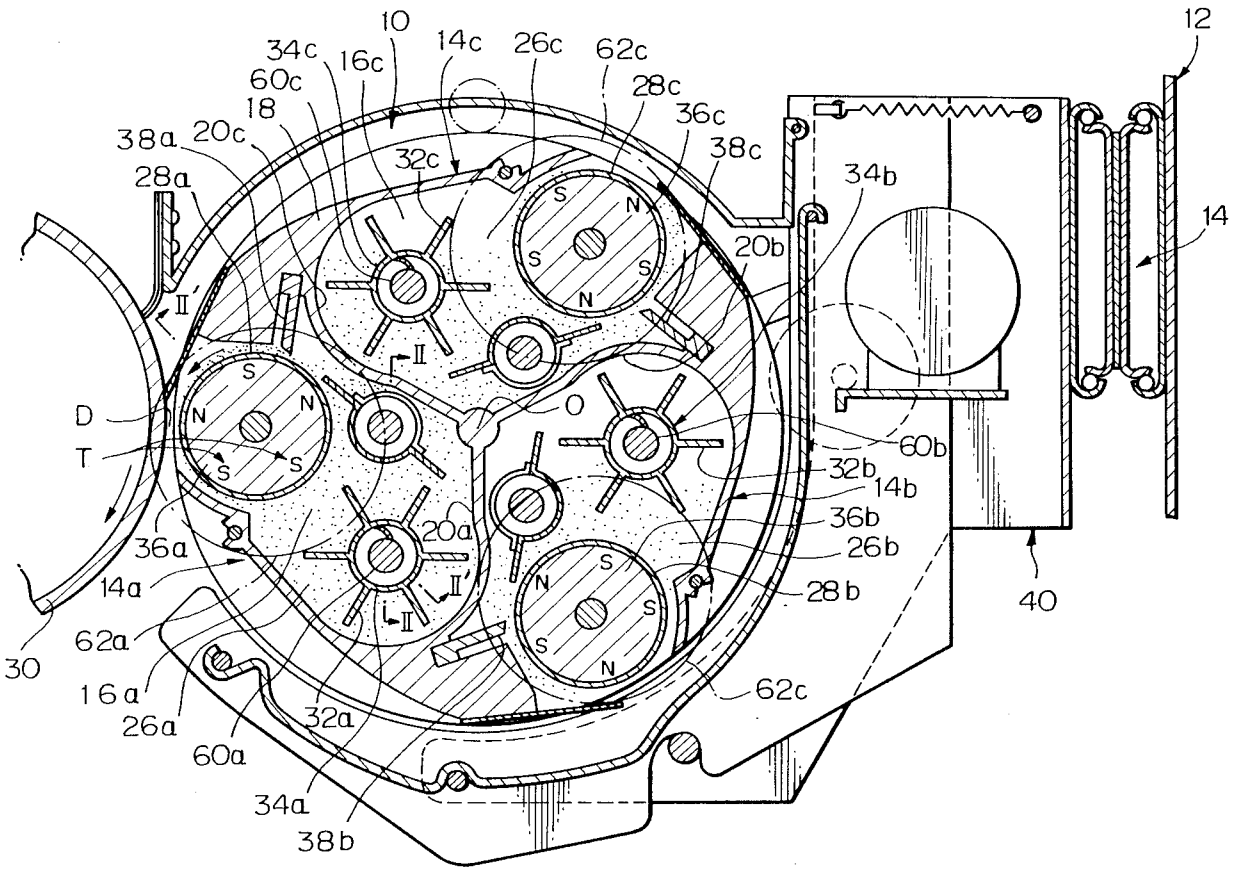
FIG. 1 is a cross-section of a developing device to which a toner supply device of the present invention is applied, the developing device being shown as being mounted in a copier body.

In FIG. 1, the developing device, generally 10, is supported by a copier body 12 and includes at least three developing units 14*a*, 14*b* and 14*c* which are provided integrally with each other. Developing chambers 16*a*, 16*b* and 16*c* are defined in, respectively, the developing units 14*a*, 14*b* and 14*c* by three partitions 20*a*, 20*b* and 20*c* of a casing member 18 and two end walls 22 and 24 (see FIG. 3) which are fixed to opposite ends of the casing member 18. The casing member 18 is made of a non-magnetic material such aluminum. Developers 26*a*, 26*b* and 26*c*, i.e., toner of different colors such as cyan, yellow and magenta are stored in the developing chambers 16*a*, 16*b* and 16*c*, respectively. If desired, a developer of a single color may be stored in all the developing chambers 16*a*, 16*b* and 16*c*. Each developer comprises a two-component developer which contains carrier and toner therein and, in this example, at least a part of it is magnetic. While the developing units 14*a*, 14*b* and 14*c* are arranged radially around the center of rotation O of the developing device, they are constructed in exactly the same manner as each other and, therefore, the following description will concentrate mainly on the developing unit 14*a* by way of example. As for the other developing units 14*b* and 14*c*, the structural elements will be designated by the same reference numerals as those of the developing unit 14*a* except for suffixes "b" and "c". This is also true with toner supply devices which are associated one with each of the developing units 14*a*, 14*b* and 14*c*, as described in detail later.

As will be described later, the developing device 10 is supported to be rotatable about the center of rotation O, so that the developing units 14*a* to 14*c* (more precisely, their developing rollers) may be sequentially brought to a predetermined developing position. In the particular condition shown in FIG. 1, the developing unit 14*a* is located at the developing position. In FIG. 1, a developer conveying member, or developing roller, 28*a* associated with the developing unit 14*a* is partly exposed to the outside through an opening which is defined by the partitions 20*a* and 20*c* (see FIG. 3 also). The developing roller 28*a* in the developing position assumes a predetermined position relative to an image carrier 30 which is rotatably supported by the copier body 12. While the image carrier 30 is shown as comprising a photoconductive drum, it may be replaced with a conductive belt or, depending upon the type of an image-forming apparatus, a dielectric image carrier in a form of drum or belt, as well known in the art. The developing roller 28*a* is located in parallel to the drum 30 with a predetermined small gap left therebetween.

A bladed wheel 34*a* having a number of blades 32*a* is disposed in the developer chamber 16*a* and rotatable counterclockwise as viewed in FIG. 1. When rotated so, the bladed wheel 34*a* feeds the developer, i.e., toner and carrier from the developer chamber 16*a* to the developing roller 28*a* while agitating it. The agitation by the blade 34*a* causes the toner to be frictionally charged to a predetermined polarity. A magnet 36*a* having S and N poles as labeled S and N in FIG. 1 is accommodated in the developing roller 28*a* and fixed to the casing member 18 of the developing device 10. As the developing roller 28*a* is rotated counterclockwise as viewed in FIG. 1, the magnetic developer 26*a* supplied to the developing roller 28*a* is retained on the roller surface by the magnetic force of the magnet 36*a* and conveyed in the counterclockwise direction. A doctor blade 38*a* is rigidly mounted on the casing member 18 to scrape the developer on the developing roller 28*a* so as to regulate the thickness of the developer layer, the regulated amount of developer being fed toward the drum 30.

On the other hand, the drum 30 is rotated clockwise as viewed in FIG. 1. Charging and exposing means, not shown, forms a latent image corresponding to a document image elctrostatically on the surface of the drum 30 by a procedure which per se is well known in the art. As the latent image reaches a developing station D at which the drum 30 and the roller 28*a* face each other, the charged toner in the developer which is also transported to the station D is electrostatically transferred from the roller 28*a* to the drum 30 to turn the latent image into a visible toner image. The toner image is transferred by a transfer device, not shown, to a paper, not shown and, then, fixed by a fixing device, not shown. The developer moved past the developing station D is returned to the developer chamber 16*a* to be mixed with the other developer within the chamber 16*a*, the resulting mixture being reused.

It is to be noted that the magnet 36*a* disposed in the developing roller 28*a* is magnetized such that two poles of the same polarity (in FIG. 10, S) neighbor each other in that portion of the magnet 36*a* which is located downstream of the developing station D with respect to the direction of rotation of the roller 28*a*. Hence, the developer reached that position T by way of the station D is separated from the surface of the roller 28*a* by the repulsion acting between those two nearby poles. Specifically, because toner is transferred to the latent image on the drum 30 while the developer is transported through the station D, the decrease in the amount of toner is compensated for by once removing the developer from the roller 28*a* to mix it with the other developer which is stored in the developer chamber 16*a*.

Figure 3:
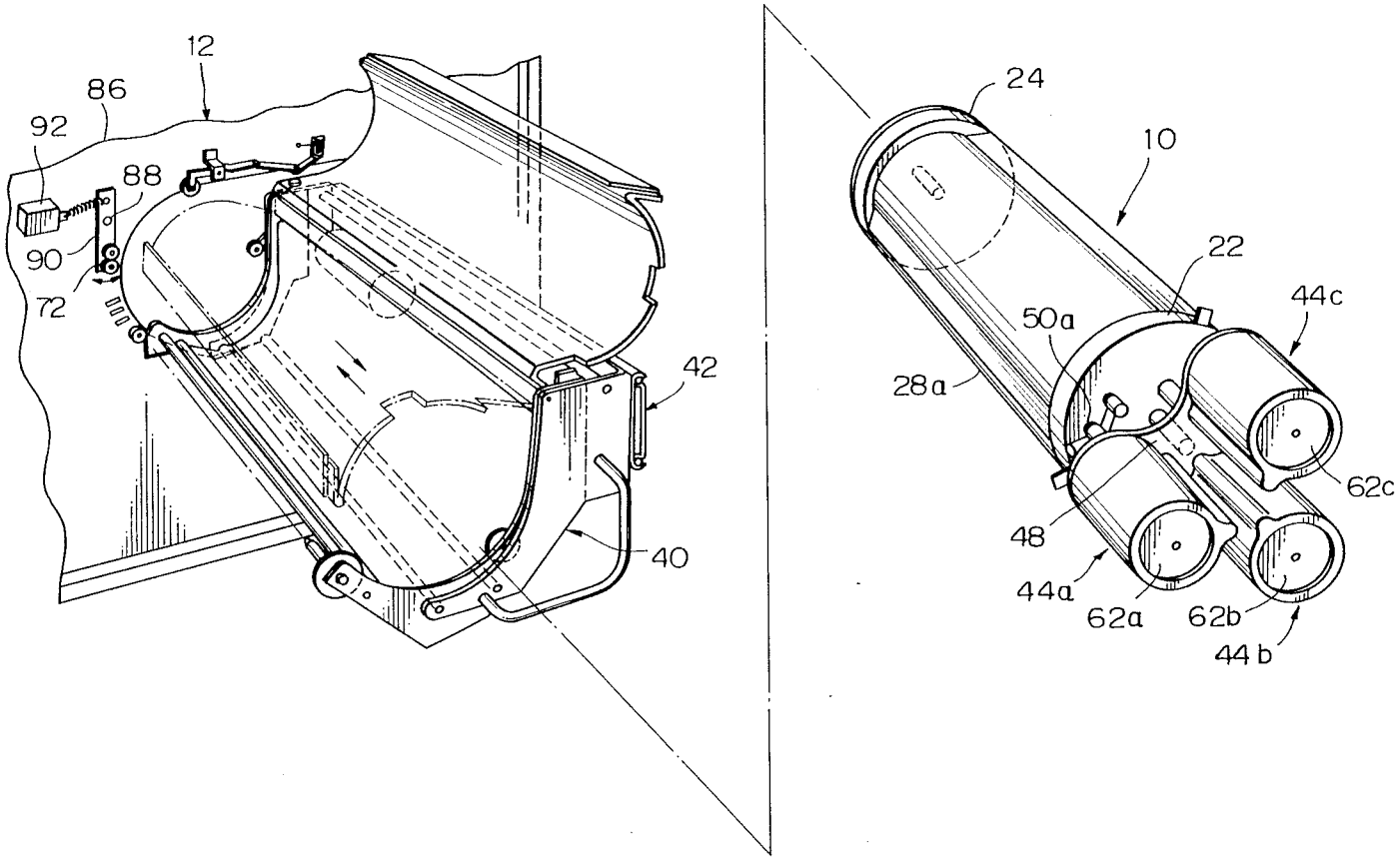
FIG. 3 is a perspective view showing a cradle pulled out from a copier body and from which the developing device is removed.

In FIGS. 1 and 3, a cradle 40 is provided for supporting the developing device 10. As shown in FIG. 3, the cradle 40 may be pulled out from the copier body 12 aided by a guide arrangement 42 so as to remove the developing device 10 therefrom.

Figure 2:
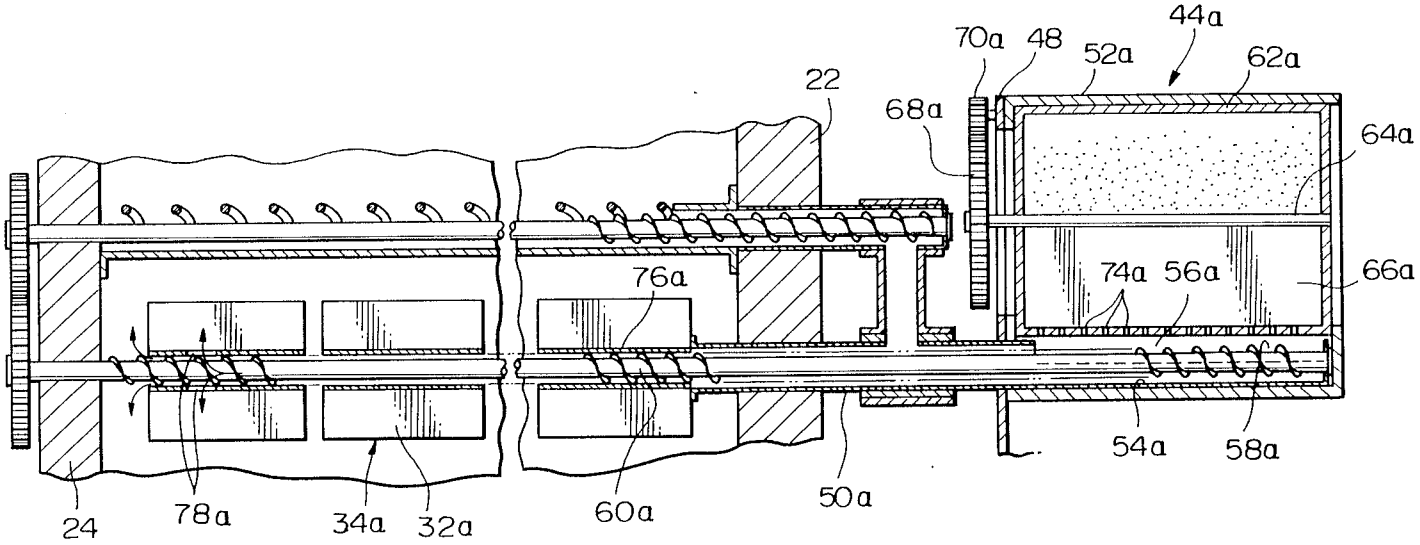
FIG. 2 is a section along lines II—II and II'—II'.
Figure 4:
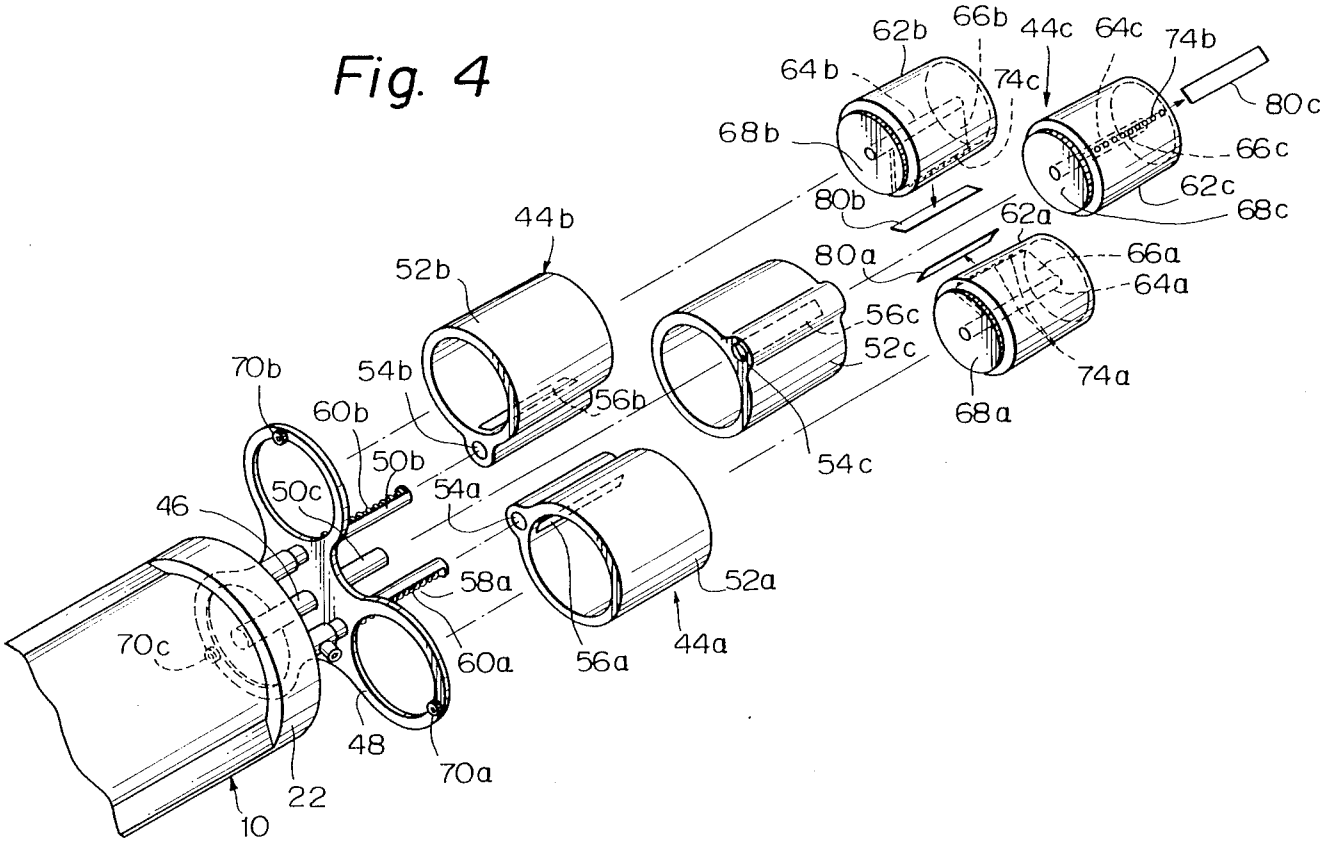
FIG. 4 is a perspective view of the toner supply device which is provided on the outer side of the developing device with respect to an intended mounting direction of the latter.

As the developing operation is repeated, the toner is sequentially transferred to the drum 30. To compensate for such toner consumption, additional toner has to be replenished to the developer chamber 16*a*. In accordance with one embodiment of the present invention, the above requirement is met by arranging the toner supply device as follows. As shown in FIGS. 2, 3 and 4, a support plate 48 is fixed through a suitable number of studs 46 to the outer end wall 22 of the developing device 10 with respect to the intended mounting direction. A toner supply conduit 50*a* is fixed to and extends throughout the end wall 22 and, further, extends through the support plate 48. An end portion of the toner supply conduit 50*a* is inserted in a bore 54*a* of a substantially cylindrical holder member 52*a*, which constitutes a part of the toner supply device 44*a*. That part of the bore 54*a* which faces the inward of the holder member 52*a* is contiguous with an opening 56*a*. This opening 56*a* is aligned with an opening 58*a* which is formed by notching the toner supply conduit 50*a*. A transport screw shaft 60*a* is rotatably supported in the conduit 50*a* and exposed to the interior of the holder member 52*a* through the openings 56*a* and 58*a*. A toner tank 62*a* is detachably mounted in the holder member 52*a* from the right-hand side as viewed in FIG. 2. In FIG. 1, the position of the toner tank 62*a* is schematically represented by a dash-an-dot line. Disposed in the toner tank 62*a* is a toner feed member which, in this particular embodiment, is implemented with a rotary body 66*a* which is rigidly mounted on a rotatable shaft 64*a*. The shaft 64*a* is journalled to opposite end walls of the toner tank 62*a*, and a gear 68*a* which is located outside of the tank 62*a* is fixed to one end of the shaft 64*a*. When the developing device 10 is mounted in the copier body 12, the gear 68*a* is meshed with a drive gear 72, FIG. 3, which is supported by the copier body 12, through an intermediate gear 70*a* which is rotatably supported by the support plate 48. The drive gear 72 is held in driven connection with a toner supply motor, not shown, through an intermediate transmission gear. While the body 66*a* is rotated within the toner tank 62*a* driven by the toner supply motor, its radially outermost end slides on the inner periphery of the cylindrical toner tank 62*a*.

As shown in FIGS. 2 and 4, the cylindrical wall of the toner tank 62*a* is provided with a number of apertures 74*a* which face the previously mentioned openings 56*a* and 58*a* to serve as toner delivery ports. While the apertures 74*a* are shown as being arranged in a single array, they may alternatively be arranged in a plurality of arrays, in a zig-zag configuration, or the like.

When a toner supply signal for commanding the supply of toner to the developer chamber 16*a* is generated, the toner supply motor is driven to rotate the rotary body 66*a* of the toner supply device 44*a* which is associated with the developing device 10. While the body 66*a* is rotated about the shaft 64*a* with its free end sliding on the inner periphery of the toner tank 62*a*, it forces the toner stored in the tank 62*a* toward the transport screw shaft 60*a* through the apertures 74*a*. Then, the shaft 60*a* being rotated transports the toner through the interior of a boss portion 76*a* of the bladed wheel 34*a*, whereby the toner is delivered into the developer chamber 16*a* through openings, or outlet ports, 78*a* which are formed through an inner end part of the boss portion 76*a*. This fresh toner is mixed with the developer in the developer chamber 16*a*. If desired, the apertures 74*a* may be replaced with a slot.

When the toner in the toner tank 62*a* becomes short or runs out, the toner tank 62*a* is pulled out of the holder member 52*a* and replaced with a new one which is filled with fresh toner. In this instance, before the new tank 62*a* is loaded in the holder member 52*a*, a seal 80, FIG. 4, which is sticked to the tank 62*a* to stop the apertures 74*a* is removed.

Figure 5:
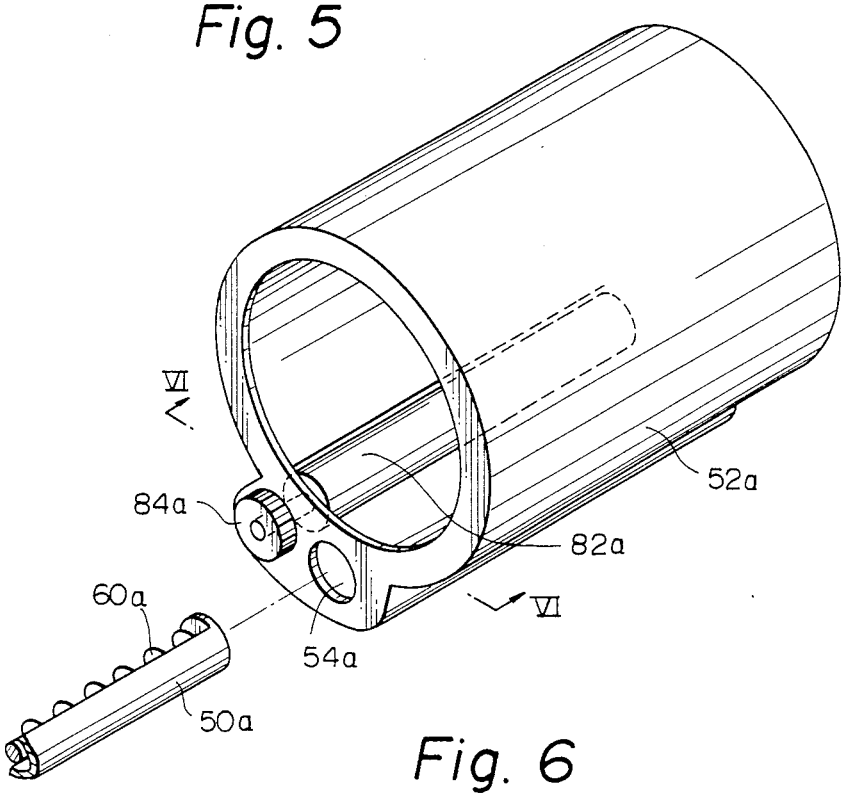
FIG. 5 is a fragmentary perspective view showing another specific construction of the toner supply device.
Figure 6:
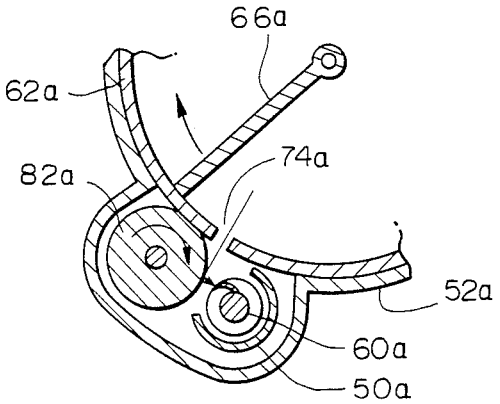
FIG. 6 is a section along line VI—VI of FIG. 5, showing a toner supply conduit inserted.

FIGS. 5 and 6 show another specific construction which uses an elastic roller 82*a* made of sponge, foamed material or the like. Specifically, the elastic roller 82*a* is rotatably disposed in the bore 54*a* of the cylindrical holder member 52*a* to extend in parallel to the transport screw shaft 60*a*. The apertures 74*a* of the toner tank 62*a* are located in the vicinity of the elastic roller 82*a*. The elastic roller 82*a* is held in pressing contact with the outer periphery of the toner tank 62*a*. Further, a gear 84*a* is rigidly mounted on a shaft of the elastic roller 82*a* and meshed with the gear 68*a*, FIG. 4, of the body 66*a*. In this configuration, at the time of toner supply, the elastic roller 82*a* is rotated together with the rotary body 66*a*, and the toner coming out through the apertures 74*a* is caused to impinge on the roller 82*a*. As a result, the toner bouncing off the roller 82*a* is directed toward the transport screw shaft 60*a*. Although not shown, a scraper is held in contact with the roller 82*a* for the purpose of scraping the toner off the roller 82*a*. The pressing contact of the elastic roller 82*a* with the toner tank 62*a* is effective to provide sealing between the roller 82*a* and the tank 62*a*, to prevent toner from being scattered to the outside of the retainer member 52*a*, and to maintain the tank 62*a* clean because toner on the tank 62*a* is removed by the roller 82*a*.

The drive gear 72, FIG. 3, adapted to drive the rotary body 66*a* as previously stated is rotatably supported by a lever 90 which in turn is pivotted to a side plate 86 of the copier body 12 by a pin 88. The lever 90 is operated by a toner supply solenoid 92 or any other suitable means. As the solenoid 92 is energized by a toner supply signal, it pulls the upper end of the lever 90 resulting that the drive gear 72 supported by the lever 90 is caused into mesh with the intermediate gear 70*a*, FIG. 4. Upon the deenergization of the solenoid 92, the lever 90 is rotated clockwise as viewed in FIG. 3 by the force of a spring, not shown, moving the drive gear 72 away from the intermediate gear 70*a*. In this manner, only when a toner supply signal is generated, the solenoid 92 is energized to bring the drive gear 72 into mesh with the intermediate gear 70*a*, whereby the body 66*a* is rotated to supply the toner. Upon the lapse of a predetermined period of time, the drive gear 72 is released from the intermediate gear 70*a* to stop the rotation of the body 66*a* to thereby interrupt the toner supply. As regards the toner supply signal, it may be generated by a toner sensor means, not shown, when the toner density has decreased beyond a predetermined reference value, as well known in the art. Alternatively, by using the fact that toner consumption is substantially proportional to the number of rotations of the developing roller 28*a*, an arrangement may be made such that when the developing roller 28*a* has been rotated a predetermined number of times, the next toner signal is generated.

Toner supply devices 44*b* and 44*c* which are constructed in exactly the same manner as the toner supply device 44*a* are associated with the other developer chambers 16*a* and 16*c*, respectively. Toner is supplied from toner tanks 62*b* and 62*c* to the developer chambers 16*b* and 16*c*, respectively.

As previously stated, when the toner in the toner tank 62*a* becomes short or runs out, the toner tank 16*a* has to be replaced with a new one. To alert the operator to such a condition, the toner supply device in accordance with the present invention is provided with a toner end sensing and displaying capability. A specific arrangement for accomplishing this capability will be described hereinafter.

The apertures 74*a* which are formed through the toner tank 62*a* as shown in FIG. 4 have a definite total area. Therefore, the amount of toner fed out by one rotation of the body 66a is constant. Stated another way, the amount of toner remaining in the toner tank 62a decreases with the increase in the number of rotations of the body 66a. It follows that the decrease of toner in the toner tank 62a to a critical degree and, hence, the need for the replacement of the toner tank 62a can be known based on the frequency or the amount of operation of the body 66a or its associated element.

Figure 7:
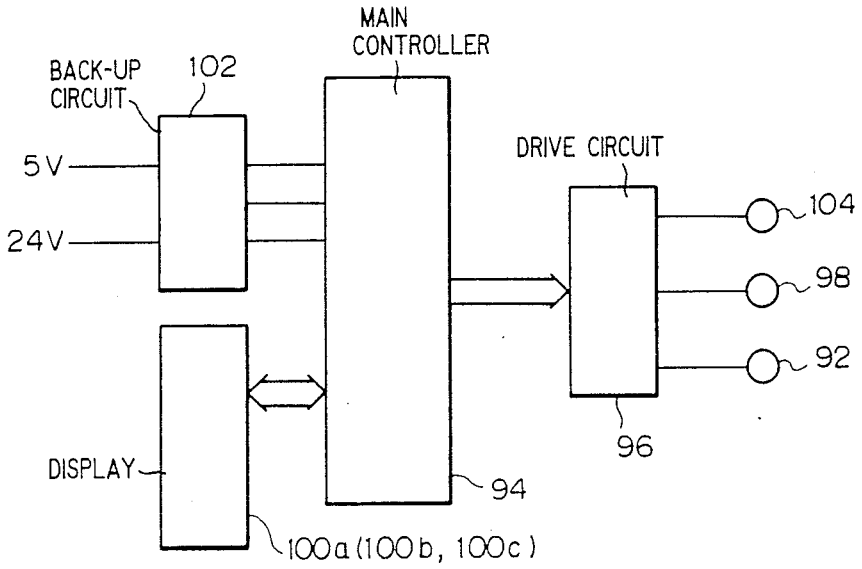
FIG. 7 is a shematic block diagram showing a main controller and electrical elements which are controlled by the main controller.

Referring to FIG. 7, there are shown in a schematic block diagram a main controller 94 built in the copier body 12, a drive circuit 96, a toner supply motor 98 for actuating the drive gear 72, FIG. 3, a toner supply solenoid 92 for causing the drive gear 72 into mesh with the intermediate gear 70a, and a display 100 for displaying the end of toner. The drive circuit 96 and the display 100 are controlled by the main controller 94. In FIG. 7, the reference numeral 102 designates a back-up circuit, and 104 a drive motor.

Figure 8:
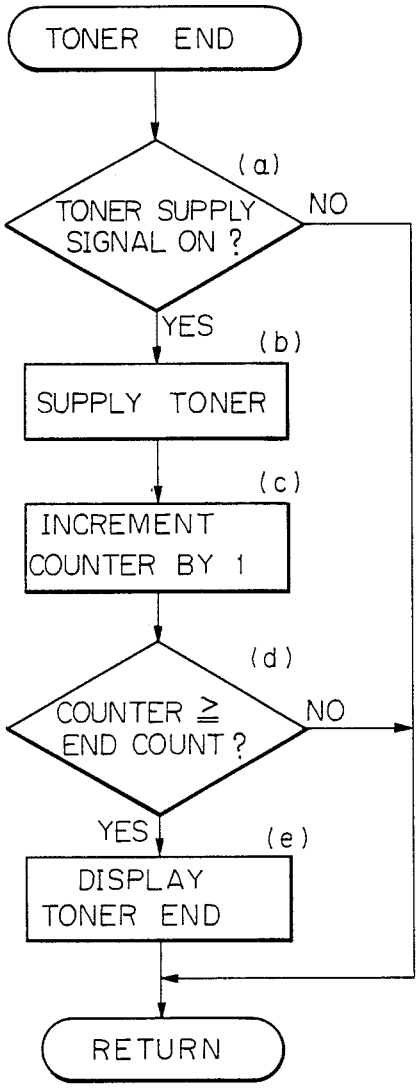
FIG. 8 is a flowchart demonstrating an exemplary sequence of steps for displaying the timing for replacing a toner tank.

FIG. 8 is a flowchart demonstrating an exemplary sequence of steps associated with toner end display. As shown, when a toner supply signal is produced as stated earlier (a), it energizes the toner supply solenoid 92 resulting that the rotary body 66a begins to rotate to start feeding the toner (b). At this instant, a preset counter is incremented by one to store the frequency of operation of the toner supply solenoid 92 (c). Every time the toner supply signal appears, the procedure described above is repeated to increment the preset counter. When the preset counter reachs a predetermined count representative of the decrease of the amount of toner in the toner tank 62a to zero or to below a predetermined one, i.e., end count (d), a toner end signal is produced to energize the display 100 for indicating the end of toner. This will urge the operator to replace the toner tank 62a with a new one.

Figure 9:
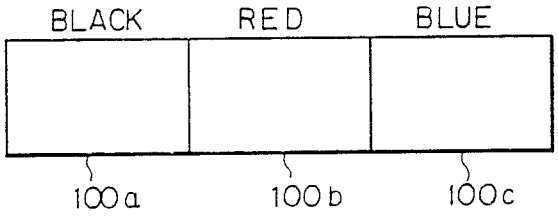
FIG. 9 is a schematic view showing indicators each showing toner end of a respective one of developing units.

The procedure described above would suffice if a single developer chamber were installed. However, in the case that a plurality of developing units, three in this embodiment, are provided, toner is supplied to each of the other developing units 14b and 14c as well. The toner supply solenoid 92, therefore, is also operated when toner is to be delivered to any of the developer chambers 16b and 16c of those developing units 14b and 14c. In such a case, an arrangement is made such that for which one of the developing units the toner supply solenoid 92 has been actuated is determined, the frequencies of operation of the solenoid 92 associated with the respective toner supply devices are counted by individual counters, and the counts of the individual counters are each compared with a predetermined end count to provide toner end display. For this purpose, as shown in FIG. 9, the display 100 is constituted by indicators 100a, 100b and 100c which respectively correspond to the toner tanks 62a, 62b and 62c of the toner supply devices 44a, 44b and 44c.

Another possible approach for toner end display in accordance with the present invention is storing, or counting, the frequency of operation of an operable member other than the toner supply solenoid 92, e.g., the number of rotations of the rotary body 66a, the frequency of movement of the lever 90 or the frequency of energization of the motor for actuating the lever 90, and generating a signal when such a frequency reaches a predetermined one. The gist is that the frequency of operation of at least one of the toner feed member and other operable members associated therewith is counted and compared with a predetermined one, toner end being displayed in response to a signal representive of a result of the comparison.

While in the above embodiment how many times the solenoid 92 has been actuated can be determined in terms of the application of current thereto, use may be made of a microswitch, photosensor or like sensor responsive to each operation of any of the operable elements so as to count its sense outputs. Needless to say, the preset counter may be replaced with a mechanical counter.

Naturally, the embodiment described above is also applicable to toner end display which is associated with a developing device having a single developing unit, a developing device of a copier, and others.

As described above, a toner supply device in accordance with the present invention is operable with a simple construction since the end of toner is sensed and displayed on the basis of the frequency of operation of a toner feed member or that of an operable means associated therewith.

Figure 10:
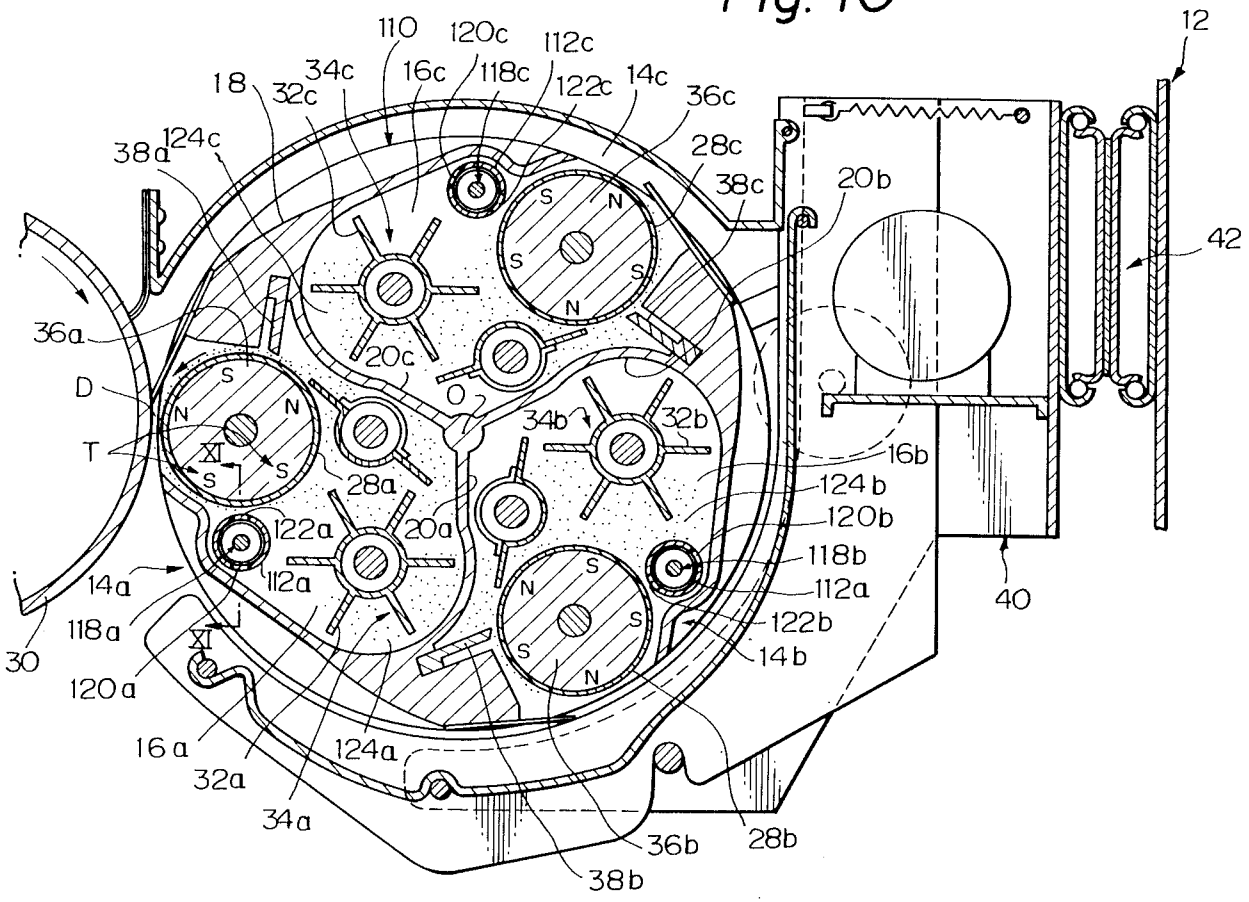
FIG. 10 is a section showing a developing device in accordance with the present invention.
Figure 11:
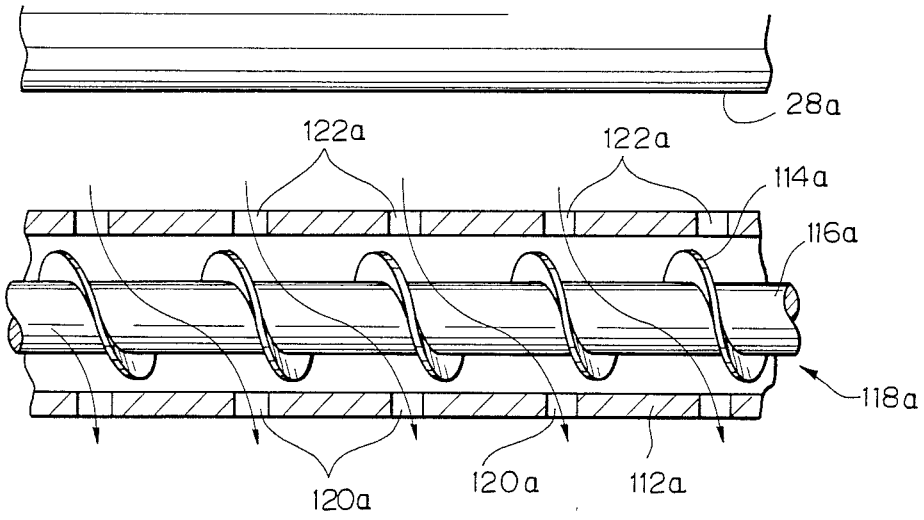
FIG. 11 is a section along line XI—XI of FIG. 10.

Referring to FIGS. 10 and 11, there is shown a developing device embodying the present invention which operates with toner supplied by a toner supply device of the present invention as stated above or by any prior art toner supply device. As shown in FIG. 10, the developing device, generally 110, is analogous to the developing device 10 of FIG. 1 with regard to the structure and, therefore, the following description will concentrate on those portions of the former which are different from the latter. Further, because all the developing units 14a, 14b and 14c are identical in construction and operation, only the developing unit 14a will be explained by way of example.

In FIGS. 10 and 11, a toner supply conduit 112a made of a non-magnetic material is disposed in the developer chamber 16a in parallel to the developing roller 28a. Extending to the outside of the developer chamber 16a, the toner supply conduit 112 is communicated to a toner tank of a toner supply device such as the one shown in FIGS. 2 to 4. The toner supply conduit 112a corresponds to the toner supply conduit 50a. Specifically, a developer transport member 118a is constituted by a helical transport screw 114a and a shaft 116a on which the screw 114a is provided. The developer transport member 118a is rotatably received in the toner supply conduit 112a. When the shaft 116a is rotated, toner forced from the toner tank into the toner supply conduit 112a is transported by the transport screw 114a until it flows out into the developer chamber 16a through some openings 120a which are formed through a lower portion of the conduit 112a at suitable intervals. If desired, the developer transport member 118a may be implemented with, for example, a wire which is coiled like a coil spring.

While additional toner is fed through the toner supply conduit 112a into the developer chamber 16a as stated above, its fluidity is poor, compared to that of carrier. Hence, should toner alone be caused to flow through the conduit 112a by the rotation of the screw shaft 116a, the transporting efficiency would become low. In the light of this, it has been customary to perforate the toner supply conduit 112a at suitable intervals to provide numerous developer inlet openings 122a, so that a developer 124a in the developer chamber 16a may be introduced into the conduit 112a through the inlet openings 122a and, by the rotation of the screw shaft 116a, mixed with the toner which is supplied from the toner tank. Because the developer 124a contains carrier, that part of the developer 124*a* which is agitated in the conduit 112*a* and contains the additional toner gains greater fluidity and, therefore, flows the conduit 112*a* smoothly to be discharged from the conduit 112*a*.

In a prior art construction of the kind described, a toner supply conduit provided in a non-magnetic transport screw shaft is simply disposed in a developer chamber to allow a developer to drop thereinto, as discussed earlier. Such an arrangement limits the amount of developer which can be introduced through inlet openings, resulting that carrier in the conduit becomes short to fail to enhance the fluidity of the developer to a sufficient degree.

To solve the above problem, in the developing device 110 of the present invention, the inlet openings 122*a* of the toner supply conduit 112*a* are located in the proximity to (in this particular embodiment, below) the previously mentioned developer separating position T of the developing roller 28*a*. In this construction, the developer separated from the developing roller 28*a* by the repulsive force of the magnet 36*a* is positively introduced into the toner supply conduit 112*a* through the inlet openings 122*a*, effectively enhancing the fluidity of the mixture inside of the conduit 112*a*. Further, because the developer removed from the developing roller 28*a* and just moved past the developing station D is low in density, i.e., it contains little toner and much carrier, feeding it into the toner supply conduit 112*a* is effective to increase the carrier concentration over the prior art. This further enhances the fluidity of the developer in the toner supply conduit 112*a*. Stated another way, the toner is effectively supplied to and agitated together with the low-density developer which is removed from the developing roller 28*a* . The developer coming out of the conduit 112*a* through the outlet openings 120*a* is agitated and dispersed by the bladed wheel 34*a*. To promote such dispersion of the developer, a wire, not shown, may be helically wound round the blades of the wheel 34*a* so as to feed the developer in a direction perpendicular to the sheet surface of FIG. 1.

While the means for removing the developer from the developing roller 28*a* has been shown and described to comprise two nearby magnetic poles of the same polarity, it may alternatively be implemented with a separator which per se is well known in the art. In such an alternative case, too, the inlet ports 122*a* of the toner supply conduit 112*a* may be located to face the separating position T to achieve the same effect.

The transport screw shaft 116*a* may be partly or entirely made of a magnetic material, and at least a part of its magnetic portion may be disposed within the reach of magnetic force of the magnet 36*a*. In this configuration, the shaft 116*a* would be magnetized by the magnet 36*a* to positively attract the developer toward it, thereby increasing the amount of developer to be fed into the toner supply conduit 112*a* through the inlet openings 122*a*. This also contributes to the enhancement of fluidity of the developer in the conduit 112*a*. Because the above effect is attainable simply by disposing the magnetic transport screw shaft 116*a* within reach of the magnetic force of the magnet 36*a*, . The effect particular to this construction would not be impaired even if the shaft 116 were simply arranged in a suitable magnetic field other than the one which neighbors the developer separating position T. Nevertheless, adopting it in combination with the construction of the present invention wherein the inlet openings 122*a* are located in the vicinity of the position T further enhances the effect.

This embodiment is extensively applicable not only to a rotary developing device but also to a developing device having a single developing unit, a developing device of a printer and other image-forming machines other than a copier, etc. Other possible applications of the above embodiment are to a developing device in which the developer conveying member is implemented with a belt, a developing device in which one or both of the developer conveying member and the magnet disposed therein are rotatable, and a developing device of the type using a non-magnetic developer.

It will be seen from the foregoing that a developing device in accordance with the present invention is, despite its simple construction, capable of effectively introducing a developer fed from a developing chamber into a toner supply conduit to thereby increase the fluidity of the developer in the toner supply conduit.

Various modifications will become possible for those skilled in the art after receiving the teachings of the present disclosure without departing from the scope thereof.

What is claimed is:

1. A dry process developing device for developing an electrostatic latent image provided on an image carrier of an image-forming apparatus by using a two-component developer which contains toner and carrier, comprising:

a developer chamber for accommodating the developer;

a developer conveying member located to face said image carrier for conveying the developer in said developer chamber to a predetermined developing station;

a developer separating member for separating the developer moved past the developing station from said developer conveying member at a predetermined separating position; and a toner supply means located in the vicinity of the separating position for both introducing fresh toner from outside into developer in said developer chamber which contains the carrier therein, and supplying a mixture of the fresh toner and the developer to said developer chamber, wherein said toner supplying means comprises a toner supply conduit for introducing the fresh toner from outside into said developer chamber, and a developer transport member disposed in said toner supply conduit for transporting the fresh toner in said toner supply conduit.

2. A developing device as claimed in claim 1, wherein said toner supply conduit comprises inlet openings formed through that part of a wall of said conduit which is located in said developer chamber for introducing into said toner supply conduit the developer which is stored in said developer chamber and contains the carrier, and outlet openings formed through said part of said wall for discharging the mixture of the fresh toner and the developer into said developer chamber.

3. A developing device as claimed in claim 2, wherein said inlet openings are situated in the vicinity of the separating position.

4. A developing device as claimed in claim 1, wherein the developer is held and transported by said developer conveying member by a magnetic force.

5. A developing device as claimed in claim 4, wherein at least a part said developer transport member is made of a magnetic material, said magnetic part of said developer transport member being located at least within reach of the magnetic force.

6. A dry process developing device for developing an electrostatic latent image provided on an image carrier of an image-forming apparatus by using a two-component magnetic developer which consists of toner and carrier, comprising:

a developer chamber for accommodating the developer;

a developer conveying member located to face said image carrier for conveying the developer in said developer chamber to a predetermined developing station, the developer being held and transported by said developer conveying member by a magnetic force;

a toner supplying means for introducing fresh toner from outside into said developer chamber, mixing the fresh toner with the developer in said developer chamber which contains the carrier therein, and supplying a mixture of the fresh toner and the developer to said developer chamber, at least a part of said toner supplying means being made of a magnetic material, said magnetic part of said toner supplying means being disposed at least within reach of the magnetic force, wherein said toner supplying means comprises toner supply conduit for introducing the fresh toner from outside into said developing chamber, and a developer transport member formed of magnetic material and disposed in said toner supply conduit for transporting the fresh toner in said toner supply conduit.

7. A developing device as claimed in claim 6, wherein said toner supply conduit comprises inlet openings formed through that part of a wall of said conduit which is located in said developer chamber for introducing into said toner supply conduit the developer which is stored in said developer chamber and contains the carrier, and outlet openings formed through said part of said wall for discharging the mixture of the fresh toner and the developer into said developer chamber.

8. A developing device as claimed in claim 6 wherein at least a part of said toner transport member is made of a magnetic material and disposed at least within reach of the magnetic force.

9. A toner supply device for supplying fresh toner to a developer chamber of a developing device which is mounted in an image-forming apparatus, comprising:

a toner tank for accommodating the fresh toner;

a toner feed member operable for feeding the fresh toner in said toner tank to the developing chamber; and a toner end sensing means for counting a frequency of operation of at least one of said toner feed member and other operable members which are interlocked with said toner feed member, and sensing an end of toner when reached a predetermined count.

10. A toner supply device as claimed in claim 9 further comprising a display means actuated when an end of toner has been sensed for urging a person to replace said toner tank.

* * * * *